US010619413B2

(12) United States Patent
Fonville

(10) Patent No.: US 10,619,413 B2
(45) Date of Patent: Apr. 14, 2020

(54) VENETIAN BLIND AND METHOD FOR ASSEMBLING SUCH A VENETIAN BLIND

(71) Applicant: Mare Beheer B.V., Haren (NL)

(72) Inventor: Eric Maria Fonville, Haren (NL)

(73) Assignee: Mare Beheer B.V., Haren (NL)

( * ) Notice: Subject to any disclaimer, the term of this patent is extended or adjusted under 35 U.S.C. 154(b) by 0 days.

(21) Appl. No.: 16/307,776

(22) PCT Filed: Jun. 7, 2017

(86) PCT No.: PCT/NL2017/050375
§ 371 (c)(1),
(2) Date: Dec. 6, 2018

(87) PCT Pub. No.: WO2017/213501
PCT Pub. Date: Dec. 14, 2017

(65) Prior Publication Data

US 2019/0309572 A1 Oct. 10, 2019

(30) Foreign Application Priority Data

Jun. 8, 2016 (NL) ..... 2016918

(51) Int. Cl.
*E06B 9/384* (2006.01)
*E06B 9/388* (2006.01)

(52) U.S. Cl.
CPC ..... *E06B 9/388* (2013.01); *E06B 9/384* (2013.01)

(58) Field of Classification Search
CPC . E06B 9/30; E06B 9/303; E06B 9/382; E06B 9/384; E06B 9/388
See application file for complete search history.

(56) References Cited

U.S. PATENT DOCUMENTS 2,486,492 A * 11/1949 Redman ..... E06B 9/388 160/173 R
2,663,367 A * 12/1953 Lorentzen ..... E06B 9/388 160/173 R (Continued)

FOREIGN PATENT DOCUMENTS

WO 2015/088349 A1 6/2015

OTHER PUBLICATIONS

International Preliminary Report on Patentability and Written Opinion of the International Searching Authority dated Dec. 11, 2018 issued in corresponding International Application No. PCT/NL2017/050375.

(Continued)

*Primary Examiner* — Johnnie A. Shablack
(74) *Attorney, Agent, or Firm* — Pillsbury Winthrop Shaw Pittman, LLP

(57) ABSTRACT

Venetian blind with slats elongated in a horizontal direction, suspended via and evenly distributed along flexible strings provided with stoppers permanently fixed to the strings in positions at a uniform pitch between each pair of successive stoppers. The stoppers and the openings in the slats are dimensioned such that the flexible strings with the stoppers thereon can be threaded through the openings in the slats. In operative condition, each slat is supported by supports and each support is carried by one of the stoppers. During assembly the strings with the stoppers are threaded through the openings, then the supports are arranged so as to be supported by the stoppers and support the slats relative to the stoppers.

9 Claims, 3 Drawing Sheets

(56) References Cited

U.S. PATENT DOCUMENTS

| | | | | |
|---|---|---|---|---|
| 2,796,927 | A * | 6/1957 | Evans | E06B 9/384<br>160/178.3 |
| 5,375,642 | A * | 12/1994 | Gaber | E06B 9/302<br>160/168.1 R |
| 5,566,735 | A * | 10/1996 | Jelic | E06B 9/262<br>160/84.04 |
| 5,983,971 | A * | 11/1999 | Miller | E06B 9/0638<br>160/170 |
| 6,557,615 | B2 * | 5/2003 | Smith | E06B 9/303<br>160/176.1 R |
| 6,799,624 | B2 * | 10/2004 | Smith | E06B 9/303<br>160/176.1 R |
| 8,991,469 | B2 * | 3/2015 | Defenbaugh | E06B 9/303<br>160/176.1 R |
| 10,030,440 | B2 * | 7/2018 | Fonville | E06B 9/307 |
| 2003/0127196 | A1 * | 7/2003 | Corey | E06B 9/32<br>160/84.05 |
| 2011/0214823 | A1 * | 9/2011 | Hu | E06B 9/30<br>160/168.1 R |
| 2015/0167380 | A1 * | 6/2015 | Farley | E06B 9/303<br>160/168.1 R |
| 2019/0017317 | A1 * | 1/2019 | Anderson | E06B 9/386 |

OTHER PUBLICATIONS

International Search Report and Written Opinion of the International Searching Authority dated Sep. 25, 2017 issued in International Patent Application No. PCT/NL2017/050375.

* cited by examiner

VENETIAN BLIND AND METHOD FOR ASSEMBLING SUCH A VENETIAN BLIND

CROSS-REFERENCE TO RELATED APPLICATION

This application is a national stage entry of PCT/NL2017/050375, filed Jun. 7, 2017, which claims priority to Netherlands Application No. 2016918, filed Jun. 8, 2016, the entire contents of both of which are herein incorporated by reference in their entireties.

FIELD AND BACKGROUND OF THE INVENTION

The invention relates to a venetian blind according to the introductory portion of claim 1 and to a method for manufacturing such a venetian blind. Such a venetian blind is known from WO2015/088349. In an example of a blind according to this document, the carriers are equipped with spacers, so that an accurate spacing between successive slats 2 is obtained. It is also described that the slats may be supported by supports that are attached to carriers such as cords, for instance by clamping. If no spacers between successive supports are provided and the carriers are flexible, the slats may be pulled up to a relatively compact configuration, for instance by pulling up cords running alongside the carriers and attached to the lowermost slat or to a bottom bar. However, manufacturing such blinds efficiently and accurately is complicated and costly.

SUMMARY OF THE INVENTION

It is an object of the present invention to provide a venetian blind that can be manufactured and transported efficiently.

According to the invention, this object is achieved by providing a venetian blind according to claim 1. The invention may also be embodied in a method according to claim 9 for assembling such a venetian blind.

Because the carriers are in the form of flexible strings provided with stoppers permanently fixed to the string in positions at a uniform pitch in longitudinal direction of the carrier between each pair of successive stoppers and the stoppers and the openings in the slats are dimensioned such that the carriers including the stoppers can be threaded through the openings in the slats, the venetian blind can be assembled in a simple manner by threading each of the carriers through openings in successive ones of the slats, wherein a number of the stoppers passes through a number of openings in the slats, arranging each of the supports on one of the strings and positioning each of the supports against one of the stoppers, and bringing the stoppers in engagement with associated ones of the slats for carrying the associated slats. In particular, the invention allows the use of carriers with pre-mounted stoppers, such as roller blind beaded chain cord, which is manufactured automatically and available at low cost, and threading the string with the stoppers through the openings in the slats, while the stoppers can carry the slats via the supports engaging both the stoppers and the slats.

Particular elaborations and embodiments of the invention are set forth in the dependent claims.

Further features, effects and details of the invention appear from the detailed description and the drawings.

BRIEF DESCRIPTION OF THE DRAWINGS

FIG. 1 is a schematic cross-sectional side view of three slats of an example of a venetian blind according to the invention with a carrier being threaded through;

DETAILED DESCRIPTION

Figure 3:
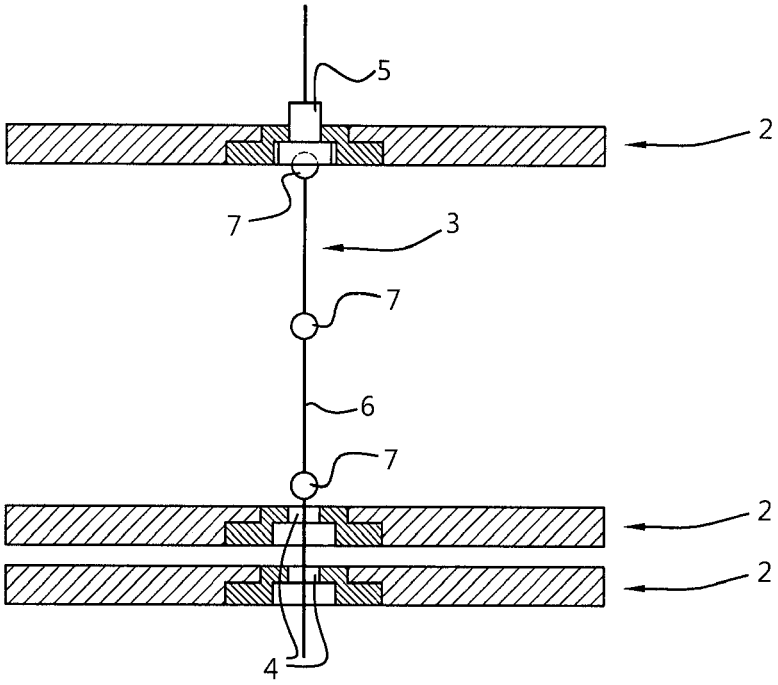
FIG. 3 is a view according to FIGS. 1 and 2 showing engagement of the support with a stopper and a slat.
Figure 4:
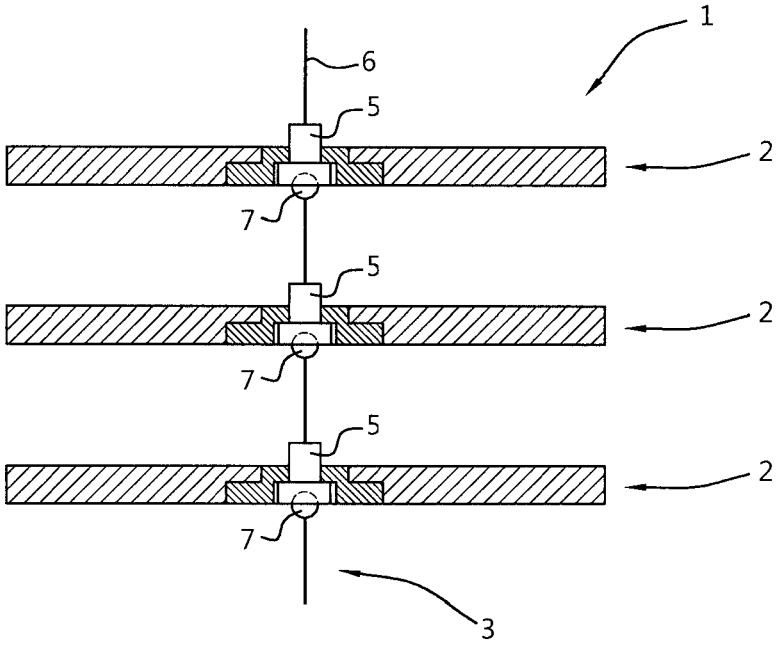
FIG. 4 is a view according to FIGS. 1-3 showing three suspended slats.

First, an example of a venetian blind according to the invention is described in operative condition with reference to FIG. 4. The venetian blind 1 has a plurality of slats 2 elongated in a horizontal direction (perpendicular to the drawing plane), suspended via and evenly distributed along carriers 3 elongated in directions with a vertical component. The venetian blind 1 forms a window cover having a horizontal size determined by the length of the slats 2 and a size perpendicular thereto determined by the length of the carriers 3. The carriers 3 extend through openings 4 (see FIGS. 1-3) in the slats 2 and include supports 5 positioned with a pitch along the carriers 3. Each support 5 supports a slat 2 adjacent to an opening 4. The carriers 3 are in the form of flexible cords 6 provided with stoppers 7 permanently fixed to the cords 6 in positions at a uniform pitch in longitudinal direction of the carrier between each pair of successive stoppers 7.

The stoppers 7 and the openings 4 in the slats 2 are dimensioned such that the carriers 3 including the stoppers 7 can be threaded through the openings 4 in the slats 2. In operative condition, each support 5 is carried by one of the stoppers 7.

For assembling such a venetian blind 1, the following items are provided:

- a plurality of elongated slats 2 with openings 4;
- a plurality of elongated flexible carriers 3 in the form of flexible cords 6 provided with stoppers 7 permanently fixed to each cord 6 in positions at a uniform pitch in longitudinal direction of the carrier 3 between each pair of successive stoppers 7; and
- a plurality of supports 5 each dimensioned for supporting one of the slats 2 adjacent to one of the openings 4 therein.

Figure 1:
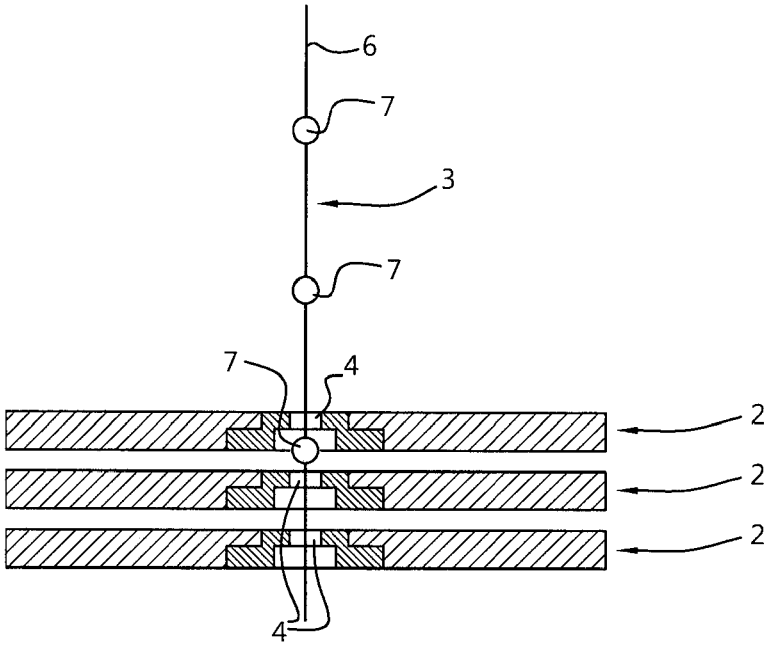
Figure 2:
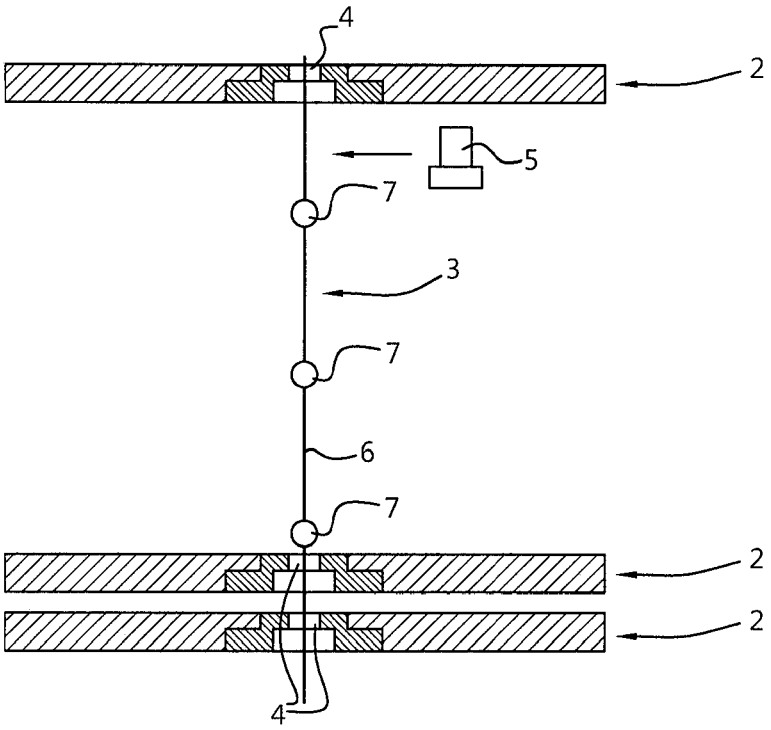
FIG. 2 is a view according to FIG. 1 showing arranging of a support onto the carrier.

Then, as is illustrated by FIG. 1, each of the carriers 3 is threaded through openings 4 in successive ones of the slats 2. This includes passing a number of the stoppers 7 through a number of openings 4 in the slats 2. Furthermore, as is illustrated by FIG. 2, each of the stoppers 5 is arranged on one of the cords 3 and positioned against one of the stoppers 7. Then, as illustrated in FIG. 3, the stopper 5 is brought in engagement with an associated one of the slats 2 for carrying the associated slat 2.

Since carriers 3 with pre-mounted stoppers 7, such as roller blind beaded chain cord which is manufactured automatically and available at low cost, can be used, and the cord 6 with the stoppers 7 can be threaded through the openings 4 in the slats 2, the blind can be assembled easily and quickly and at low costs. Since the stoppers 7 can carry the slats 2 via the supports 5 forming an interface between the stoppers 7 and the slats 2, the stoppers 7 can nevertheless be used for determining the horizontal positions of the slats 2.

Figure 6:
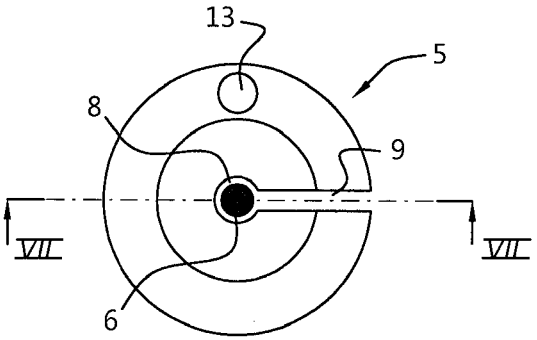
FIG. 6 is an enlarged top view of support with a portion of a carrier.
Figure 7:
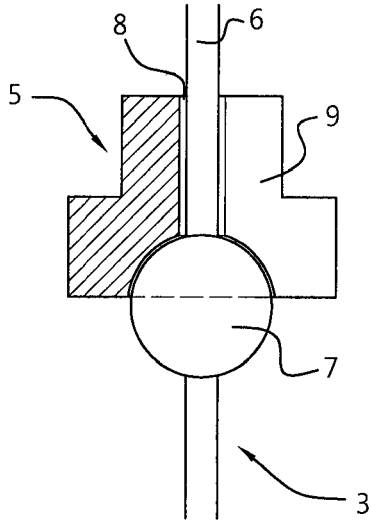
FIG. 7 is a view along the line VII-VII in FIG. 6.

Mounting the supports to the string can be achieved in many ways, for instance by connecting support halves to each other with the string in-between. As is best seen in FIGS. 6 and 7, a particularly efficient manner of assembling is allowed by providing that each support 5 has a passage 8 through which the cord 6 extends, the passage 8 having a side opening 9 in a direction transverse to the cord 6 over the length of the passage 8 for allowing sideways insertion of the cord 6 into the passage 8.

In operative condition, each passage 8 accommodates at least a portion of one of the stoppers 7, at least that portion of the stopper 7 and the side opening 9 being dimensioned such that the stopper 7 is prevented from escaping sideways out of the passage 8. Thus, after the stopper 7 engages the support 5, the cord 6 can no longer slip out of the opening 8.

For a particularly reliable positioning of the stoppers 7, it is preferred that the stoppers 7 are injection moulded to the cord 6.

Figure 5:
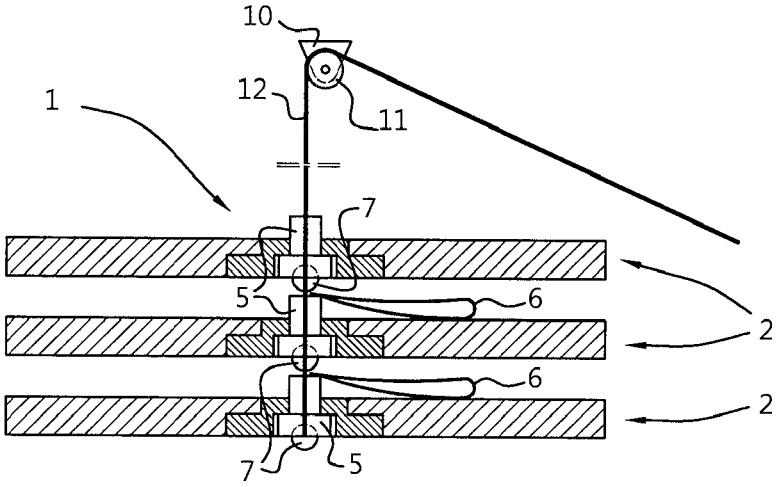
FIG. 5 is a view according to FIGS. 1-4 showing slats in raised condition in conjunction with a top mount.

As is shown in FIG. 5, the venetian blind may be equipped with a top mount 10 with pulleys 11 and pull-up cords 12 guided over the pulleys 11 and connected to a bottom one of the slats 2 or to a bottom bar for pulling up the bottom one of the slats 2 or the bottom bar, thereby entraining the other slats 2. Thus, the venetian blind can be lifted in a simple manner and to a compact configuration because cord sections 6 between the stoppers 7 can assume folded or looped configurations between the slats 2.

A particularly efficient construction is obtained if the pull-up cords 12 are each guided through a vertical row of the supports. To this end, the support shown in FIGS. 6 and 7 is provided with a pull-up cord guide passage 13.

The openings and the supports are preferably arranged for providing stable support for each of the slats in at least two, mutually distinct positions as is disclosed in WO2015/088349, so that the slats can be turned individually or in subgroups into a number of predefined orientations.

While in the described example cords are used for carrying the slats and pulling-up the slats, also belts or other types of flexible pulling strings may be used.

The invention claimed is:

1. A venetian blind comprising a plurality of slats elongated in a horizontal direction, suspended via and evenly distributed along carriers elongated in directions with a vertical component, so as to form a window cover having a horizontal size determined by the length of the slats and a size perpendicular thereto determined by the length of the carriers, wherein the carriers extend through openings in the slats, the carriers comprise supports positioned with a pitch along the carriers, each support supporting one of the slats adjacent to one of said openings, wherein the carriers are in the form of flexible strings provided with stoppers permanently fixed to the strings in positions at a uniform pitch, in a longitudinal direction of the carrier, between each pair of successive stoppers;

the stoppers and the openings in the slats are dimensioned such that the flexible strings including the stoppers can be threaded through the openings in the slats; and in operative condition, each support is carried by one of the stoppers.

2. The venetian blind according to claim 1, wherein the stoppers are injection moulded to the string.

3. The venetian blind according to claim 1, wherein the stoppers are ball-shaped and the carrier is a cord.

4. The venetian blind according to claim 1, wherein the openings and the supports are arranged for providing stable support for each of the slats in at least two, mutually distinct positions.

5. The venetian blind according to claim 1, wherein each support has a passage through which the string extends, the passage having a side opening in a direction transverse to the string over the length of the passage for allowing sideways insertion of the string into the passage.

6. The venetian blind according to claim 5, wherein, in operative condition, each passage accommodates at least a portion of one of the stoppers, at least the portion of the stopper and the side opening being dimensioned such that the stopper is prevented from escaping sideways out of the passage.

7. The venetian blind according to claim 1, further comprising a top mount with pulleys and pull-up strings guided over the pulleys and connected to a bottom one of the slats or to a bottom bar for pulling up the bottom one of the slats or the bottom bar, thereby entraining the other slats.

8. The venetian blind according to claim 7, wherein the pull-up strings are each guided through a vertical row of the supports.

9. A method for assembling a venetian blind comprising:

providing a plurality of elongated slats with openings;

providing a plurality of elongated flexible carriers in the form of flexible strings provided with stoppers permanently fixed to each string in positions at a uniform pitch, in longitudinal direction of the carrier, between each pair of successive stoppers;

providing a plurality of supports each dimensioned for supporting one of the slats adjacent to one of the openings therein;

threading each of the carriers through openings in successive ones of the slats, wherein a number of the stoppers pass through a number of openings in the slats;

arranging each of the supports on one of the strings and positioning each of the supports against one of the stoppers; and bringing the stoppers in engagement with associated ones of the slats for carrying the associated slats.

* * * * *